US005842637A

United States Patent [19]

Lanzer

[11] Patent Number: 5,842,637

[45] Date of Patent: Dec. 1, 1998

[54] ANGLED JOINT FOR RAILROAD RAILS

[75] Inventor: Delmar A. Lanzer, Woodburn, Ind.

[73] Assignee: Midwest Rail Inc., Fort Wayne, Ind.

[21] Appl. No.: 863,607

[22] Filed: May 27, 1997

Related U.S. Application Data

[63] Continuation of Ser. No. 502,120, Jul. 13, 1995, abandoned.

[51] Int. Cl.[6] ..... E01B 11/00

[52] U.S. Cl. ..... 238/152; 238/159; 238/230

[58] Field of Search ..... 238/152, 153, 238/159, 230, 231, 232, 243, 251, 260

[56] References Cited

U.S. PATENT DOCUMENTS

| | | | |
|---|---|---|---|
| 846,901 | 3/1907 | Bossert | 238/154 |
| 1,772,391 | 8/1930 | Evers | 238/232 |
| 2,130,106 | 9/1938 | Schermerhorn | 238/153 |
| 2,989,240 | 6/1961 | Lansing | 238/159 |
| 2,996,088 | 8/1961 | Hensley | 143/46 |
| 3,069,950 | 12/1962 | Hensley | 83/168 |
| 3,163,069 | 12/1964 | Edmon | 83/303 |
| 3,686,990 | 8/1972 | Margolien | 83/489 |
| 4,318,324 | 3/1982 | Hall et al. | 83/397 |
| 4,364,311 | 12/1982 | Platt, III | 100/6 |
| 4,574,670 | 3/1986 | Johnson | 83/409 |
| 4,873,902 | 10/1989 | Krieg | 83/745 |
| 5,086,678 | 2/1992 | Aoyagi | 83/13 |

FOREIGN PATENT DOCUMENTS

| | | | |
|---|---|---|---|
| 631340 | 12/1927 | France | 238/230 |
| 1041124 | 10/1953 | France | 238/231 |

*Primary Examiner*—S. Joseph Morano
*Attorney, Agent, or Firm*—Baker & Daniels

[57] ABSTRACT

The present invention involves a power saw for cutting railroad rails at an angle. The power saw includes a base, a cutting location disposed proximate the base, a cutting disc and associated driving mechanism, and a device for moving the cutting disc and changing the angle of the cutting disc relative to the cutting location. A table supports the cutting disc and driving mechanism, and the base has two pivots selectively engageable with the table. The driving mechanism of the cutting disc includes a cam based oscillating device for oscillating the cutting disc during cutting of a railroad rail. The power saw also includes a guide and a conveyor system for positioning a railroad rail on the cutting location. The conveyor system moves railroad rails to the guide. A device for applying force against the direction of the cutting force of the cutting disc is located at the cutting location. A device for delivering a fluid, a coolant, lubricant, or rust-inhibiting solution, is located adjacent to the cutting disc. A device for aligning the cutting disc with the cutting location maintains the low point of the cutting disc in alignment with the cutting location. The resulting joint for a railroad rail comprises a pair of rails having matching ends disposed at an angle in the range of about 5° and 30°, a dielectric material disposed between the ends, and a bar attached to and connecting the rails.

7 Claims, 3 Drawing Sheets

ANGLED JOINT FOR RAILROAD RAILS

This is a continuation of application Ser. No. 08/502,120 filed Jul. 13, 1995 now abandoned.

BACKGROUND OF THE INVENTION

1. Field of the Invention.

The present invention involves joints for railroad rails. More particularly, the present invention relates to the method of manufacturing and the structure of railroad joints.

2. Description of the Related Art.

Conventionally, railroad rail joints are made by adhering two straight cut rail pieces. One known method of cutting railroad rails involves using an instrument providing an oxy-fuel flame, such as produced by acetylene, natural gas, or other fuel and oxygen mixtures. Unfortunately, cutting with an oxy-fuel system has many undesirable side effects, namely: heat distortion of the rail; poor accuracy of the cut; poor quality of the cut; inability to weld the rail; and the requirement than the end of the cut be ground off before further attachment. These negative effects make oxy-fuel cutting instruments undesirable for many applications.

Another known method of cutting railroad rails involves using an abrasive power saw with a silicon carbide grinding disc. The grinding disc is applied to the rail perpendicular to the axis of the rail to create a 90° cut. A relatively high horsepower motor, e.g. 75 horsepower, drives the grinding disc and is securely located on the floor so that the grinding disc is accurately positioned against the high resistance of the rail to cutting. Typically, the rails are considerably longer than the power saw, e.g. eighty feet, requiring that a conveyor system be installed adjacent to the power saw. This type of cutting creates a relatively smooth surface at the end of the rail, and facilitates the incorporation of two ends of rails into a new rail joint.

Insulated rail joints are conventionally made by connecting the ends of two cut rails in an arrangement which electrically isolates the connected rail portions. A dielectric padding is placed in the gap between the ends of the rails to prevent direct conduction between the rail portions. A steel reinforcing bar or brace is attached to each rail portion to securely join them together. The steel reinforcing bar includes a dielectric barrier which is glued and cured on the surface of each bar which contacts a rail. Each rail end also has a series of holes near its abutting end, and dielectric sleeves are disposed in the holes so that metal bolts may be used to connect the bar with the rail portion. Finally, an adhesive is applied and cured before the bolts are tightened so that the dielectric barriers between the rail portions are securely disposed between the conductive portions of each rail.

A drawback of the above-described connection of straight cut rails is that the gap between the straight cuts of two joined rails creates a gap in the rail which does not support the trains. Although the dielectric material in the gap prevents electrical conduction between the rail ends, that material is not as physically durable as the hard steel of the rail. Also, the thermal expansion and contraction of rail segments, which are often miles long, requires that the joint be made structurally secure to withstand the resulting forces. Consequently, the gap presents an interruption between the contiguous rails which guide the train and creates a "bump" during the traversal of the train.

The rail material adjacent each gap may be rolled over by the force of the trains traversing over the tracks, and the rolled material eventually electrically connects and thereby shorts out the switching signals conventionally transmitted over the rail line. The problem of rolled over rail ends can be temporality solved by grinding out the rolled over material bridging the gap, but using that type of correction further deteriorates the joint.

One known attempt to avoid the problems inherent in the gap between rail portions utilizes a 45° cut of the rail. With this method, the gap between the rail ends is bridged by the angled portions created by the cut. While initially this design is effective in eliminating the "bump" created by the gap, this design may not be reliable over time. Trains apply such a large load on the rail that the relatively thin angled ends may shear off, leaving an even greater gap than the joints with a 90° cut. Notwithstanding the potential difficulties with the 45° joint, manufacturing such a joint with conventional power saws requires that the rail be placed at a 45° angle relative to the grinding disc. This arrangement is difficult to accomplish, and the relative orientation may drift over repeated cuttings.

What is needed in the art is an improved power saw for railroad rails, and specifically, a power saw for cutting railroad rails at an angle.

Also needed is an improved joint for railroad rails.

SUMMARY OF THE INVENTION

The present invention an improved angle-cut rail joint which may be manufactured by an inventive power saw. The method involves pivoting the power saw allowing for the cutting angle to bisect the rail without disturbing the integrity of the cut. An alignment mechanism of the power saw orients the grinding disc at the center of the rail being cut regardless of the angle of the cut. The improved angle-cut rail joint utilizes the inventive power saw to cut an angle from 5° to 30°, from a plane perpendicular to the axis of the rail so that the joint bridges the gap between rail ends without excessively weakening the distal end of the angled cut rail end.

While an ordinary piece of material can be held at an angle for the saw, rails typically range from 40 to 80 feet long and cannot be manipulated like a smaller piece. Therefore, the cutting angle must be created not by manipulation of the position of the rail to be cut, but rather by the position of the saw blade relative to the fixed position of the rail. In addition, the mechanism positioning the grinding disc must be well anchored so that the disc may be driven into the rail with the needed force. The invention involves the addition of features to a power saw which enables the saw to cut through railroad rails at a variable angle.

The power saw of the present invention includes a dual pivot point mechanism which allows for aligning the center of the cutting blade approximately over the center of the rail regardless of the cutting angle. The power saw also includes an oscillating mechanism with an adjustable stroke for slightly varying the location of the cutting action to lessen the power needed and to reduce the heat produced during cutting. Also, the power saw includes a hydraulic lift that exerts an upward bias beneath the cutting blade to prevent the blade from being trapped on account of the downward pressure of the blade on the rail.

In addition to the cutting mechanism itself, the power saw has other advantageous features. The rail is clamped by a mechanism connected to a conveyor system so that the saw mechanism is not effected by the movement of the rails. The saw is also equipped with a cooling system for delivering water and a lubricant, e.g., a soluble oil, to the site of the cut to minimize thermal damage. A rust-inhibiting solution is also delivered to the cutting site to reduce the oxidation of the rails.

The present invention, in one form, is a joint for a railroad rail including a pair of rails, a dielectric material, and a bar. The pair of rails have matching ends, each of the respective rails defining an axial center. The facing surface of each end is disposed at an angle in the range of about 5° and 30° relative to a plane perpendicular to the axial center of the rails. The dielectric material is disposed between the rail ends. The bar is attached to and connects the rail ends.

The present invention, in one form, is a method of manufacturing a rail joint. The method includes attaching a dielectric barrier to a bar. Then a rail is cut into two complementary end rails. The dielectric barrier is disposed between the end rails, the end rails are connected to the bar to trap the dielectric material. The rail is cut at an angle in the range of 5° to 30° relative to a plane perpendicular to the axial center of the rail.

An advantage of the present invention is that it can cut a railroad rail at an angle by pivoting the cutting mechanism relative to the position of the railroad rail to be cut.

Another advantage is that the cutting mechanism oscillates as it contacts and cuts the railroad rail, reducing the heat created during cutting. Provision of water and a lubricant to the cutting site during cutting further reduces heat and stress to the rail during cutting.

Yet another advantage is that railroad rails cut at an angle and joined reduce the bump experienced by trains upon traversing rail joints.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
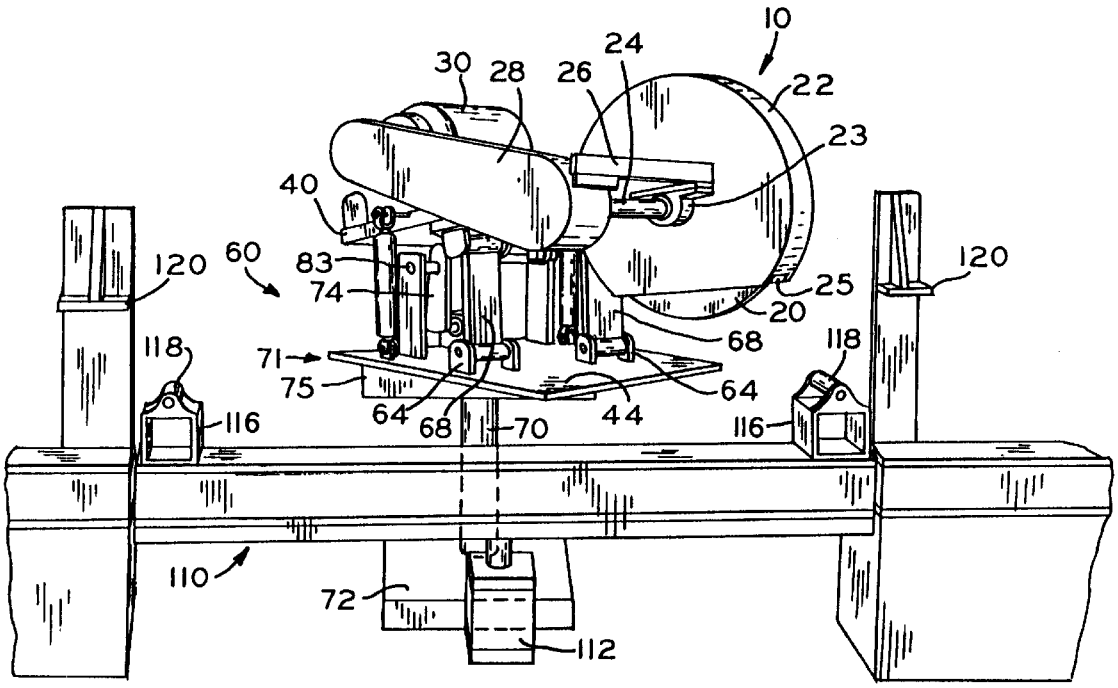
FIG. 1 is a perspective view of the power saw of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates one preferred embodiment of the invention, in one form, and such exemplifications are not to be construed as limiting the scope of the invention in any manner.

DESCRIPTION OF THE EXEMPLARY EMBODIMENTS

The exemplary embodiment disclosed below is not intended to be exhaustive or limit the invention to the precise form disclosed in the following detailed description. Rather, the embodiment is chosen and described so that others skilled in the art may utilize its teachings.

Figure 5:
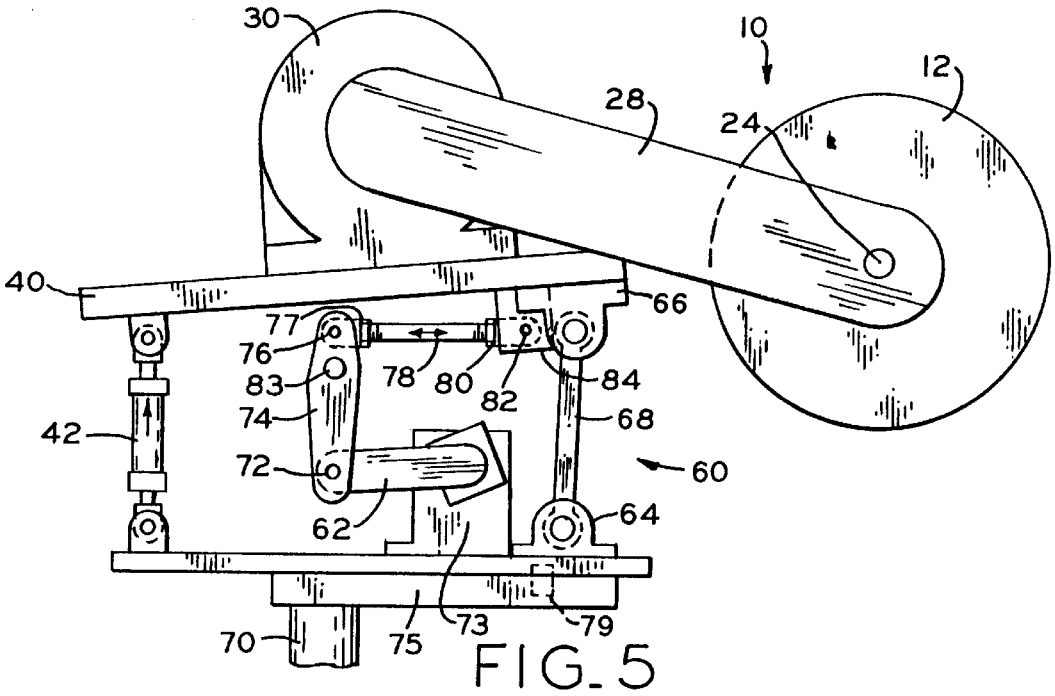
FIG. 5 is a side view, in schematic form, of the power saw of the present invention.
Figure 6:
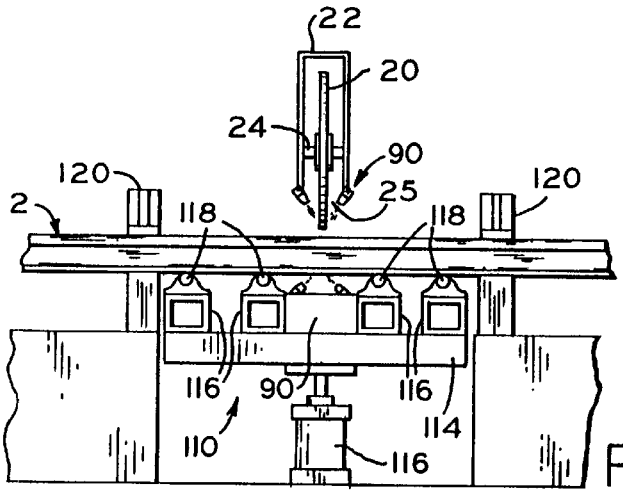
FIG. 6 is a front view of the grinding disc and cutting location of the power saw.

In accordance with the present invention, an angled power saw for railroad rails includes cutting mechanism 10 (FIG. 5), pivoting arrangement 71 (FIG. 1), oscillating mechanism 60 (FIG. 6), hydraulic lift 112 (FIG. 1), conveyor system 110 (FIG. 1), and cooling system 90 (FIG. 6). The various motors and hydraulic cylinders of the power saw and conveyor system may be operated manually or with an electronic or microprocessor based control system. While the remainder of the specification describes the invention in terms of a manual control, the provision of an electronic or microprocessor control is contemplated with the present invention.

Cutting mechanism 10 (FIGS. 1 and 5) includes platform 40 upon which is fixedly mounted saw motor 30, which powers cutting mechanism 10. Saw motor 30 is a relatively high horsepower motor, e.g. 75 horsepower. Arm 28 is pivotally coupled at one end thereof to saw motor 30. At another end thereof, arm 28 is attached to support 26 at one end thereof. At a second end thereof, support 26 includes sleeve 23 fixedly joined to disc housing 22. Grinding or cutting disc 20 is disposed within disc housing 22 and rotates about rod 24. Rod 24 is rotatably attached at one end thereof to arm 28, and at another end thereof passes through sleeve 23 and into disc housing 22 to rotatably connect with grinding disc 20. Power is provided from saw motor 30 to grinding disc 20 via rod 24. Grinding-disc 20 is disposed within disc housing 22 and rotates about rod 24. A portion of grinding disc 20 protrudes from opening 25 in disc housing 22 in order to contact rail 2. Cooling system 90 (FIG. 6) is connected to opening 25 and provides coolant and a rust-inhibiting solution at the site at which grinding disc 20 contacts rail 2. Cooling system 90 is also mounted on beam 114 to provide coolant and a rust-inhibiting solution to the cutting site from below grinding disc 20. Cooling system 90 comprises one or more fluid lines for conveying a coolant to the cutting site, with the fluid lines terminating in nozzles or other suitable arrangements to direct the coolant to the rail being cut. The coolant may include water, a lubricant, or other suitable fluids.

Pivoting arrangement 71 includes base 44 (FIGS. 1, 2, 3, 4, 5, and 7) pivotally mounted on support 75 via one of three pins 79A, 79B, or 79C (FIGS. 2, 3, 4, and 5). Base 44 may be supported on support 75 with rollers, bearings, lubricated contacting surfaces, or any combination or functional equivalent creating a movable connection. The interface between base 44 and support 75 preferably includes shielding to prevent the penetration of moisture or abrasive materials into the interstices between the contacting surfaces.

Figure 2:
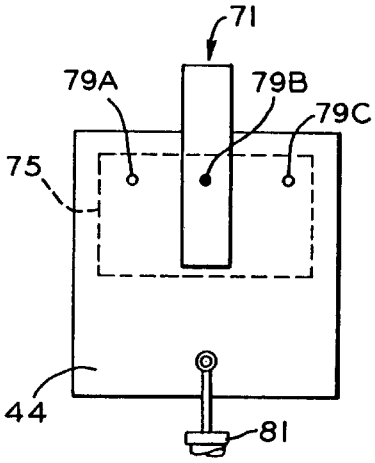
FIG. 2 is a top plan view, in schematic form, of the power saw of the present invention.
Figure 3:
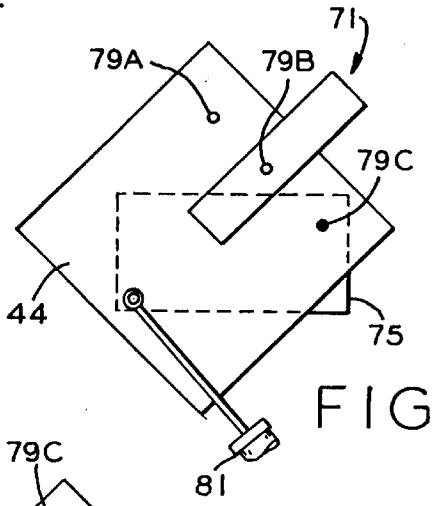
FIG. 3 is a top plan view, in schematic form, of the power saw of the present invention pivoted on one of its pivot points.
Figure 4:
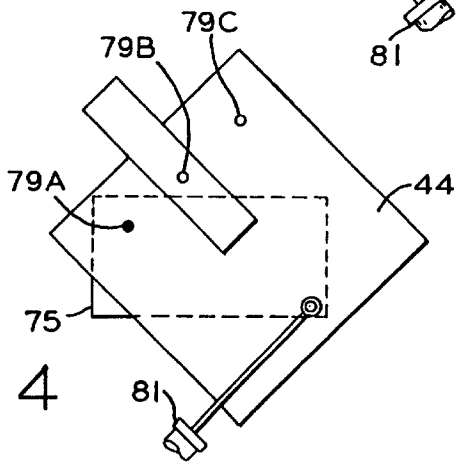
FIG. 4 is a top plan view, in schematic form, of the power saw of the present invention pivoted on the other of its pivot points.

Selection of one of pins 79A, 79B, or 79C determines the pivotal orientation of base 44 relative to support 75. After activation of one of pins 79A, 79B, or 79C to determine the pivotal orientation of base 44 relative to support 75, hydraulic cylinder 81 actuates to pivot base 44 about selected pin 79A, 79B, or 79C, then secures base 44 in the selected pivotal position relative to support 75. Three possible alternative positions of base 44 relative to support 75 are shown in FIGS. 2, 3, and 4, although any angle from 0° to 45° degrees in either direction may be selected. Support leg 70 is rigidly secured to support 75, and to the floor.

Oscillating mechanism 60 is mounted on base 44 and includes support member 68 disposed between block 64, fixedly mounted to base 44, and block 66, fixedly mounted to platform 40. Oscillating mechanism 60 also includes arm 63 pivotally joined at one end thereof to cammed motor 73 and pivotally connected to one end of joint 72. Arm 74 is pivotally mounted on rod 83. At another end thereof, rod 72 is pivotally attached to one end of arm 74. At the other end thereof, arm 74 is pivotally attached by joint 76 to yoke 77 at one end of shaft 78. Yoke 80 at another end of shaft 76 is attached by bolt 82 to anchor 84. Upon activation, cammed motor 73 displaces arm 62, which pivots about joint 72, which in turns displaces arm 74. Arm 74 pivots about rod 83, which in turn pivots shaft 78 about joint 76. Shaft 78 thus displaces yoke 80, providing an oscillating motion to platform 40.

Hydraulic cylinder 42 (FIGS. 1, 5, and 7) is disposed between platform 40 and base 44 to pivot cutting mechanism 10 on support member 68 and to apply downward pressure and cutting force on rail 2. Also, arm 28 is pivotally mounted over the plane of platform 40 at a location which results in arm 28 angling downward. Arm 28 and the height of support member 68 is arranged so that as grinding disc 20 cuts through rail 2, the pivoting movement of arm 28 does not substantially effect the cutting location of grinding disc 20. This arrangement results in the lower most point of grinding disc 20 being maintained at about the same position relative to the rail being cut. Thus during cutting of the rail, the full force of the cutting mechanism is applied downward on the cutting surface rather than having only a component of the full force being applied at an angle to rail 2. While the cutting is occurring, oscillating mechanism 60 varies the exact location of the lowest most point of grinding disc 20 relative to a horizontal plane through rail 2 so that the heat of the cutting action is distributed. The oscillation motion, in conjunction with the operation of hydraulic cylinder 42 and the pivoting of platform 40 on support member 68, provides proper alignment of grinding disc 20 during the cutting of rail 2.

Conveyor system 110 (FIGS. 1 and 6) includes hydraulic lift 112 upon which is mounted beam 114. Blocks 116 are mounted upon beam 114 and include rollers 118. Rail 2 rolls over rollers 118 as it is conveyed through conveyor system 110 for cutting. When rail 2 is correctly positioned for cutting, it is firmly held between clamps 120 and rollers 118, hydraulic lift 112 exerting an upward force to counter the downward cutting force of grinding disc 20 as it is brought into cutting contact with rail 2.

To cut a rail 2 at an angle, the rail 2 to be cut is first conveyed along conveyor system 110 until rail 2 is positioned so that grinding disc 20 will contact rail 2 at the desired cutting location. Rail 2 is clamped between clamps 120 and rollers 118, while hydraulic lift or pusher 112 exerts an upward force on rail 2. One of pins 79A, 79B, or 79C is selected to determine the orientation of base 44 relative to support 75. After activation of one of pins 79A, 79B, or 79C to determine the pivotal orientation of base 44 relative to support 75, hydraulic cylinder 81 pivots base 44 through a controlled angle about selected pin 79A, 79B, or 79C, then secures base 44 in the selected pivotal position relative to support 75 to achieve the desired cutting angle at which grinding disc 20 will engage rail 2. Saw motor 30 powers grinding disc 20 with sufficient power to cut through rail 2. Fluid is supplied within hydraulic cylinder 42, thereby pivoting platform 40 and cutting mechanism 10 downward so that grinding disc 20 contacts rail 2. Oscillating mechanism 60, powered by the cammed motor 73, allows cutting mechanism 10 to oscillate as grinding disc 20 contacts rail 2. When grinding disc 20 contacts rail 2, cooling system 90 provides water, a lubricant, and a rust-inhibiting solution to the cutting site.

Figure 8:
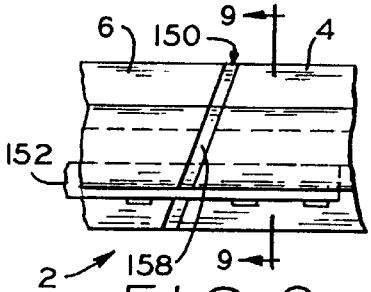
FIG. 8 is a top view of the angled rail joint of the present invention.
Figure 7:
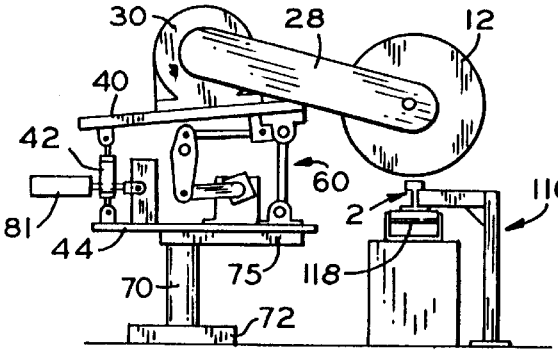
FIG. 7 is a side view of the power saw, conveyor system, and guide rail.
Figure 9:
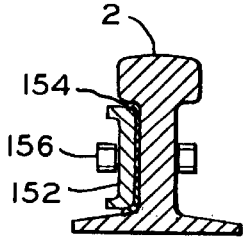
FIG. 9 is a side, sectional view taken along view line 9—9 of FIG. 8.
Figure 10:
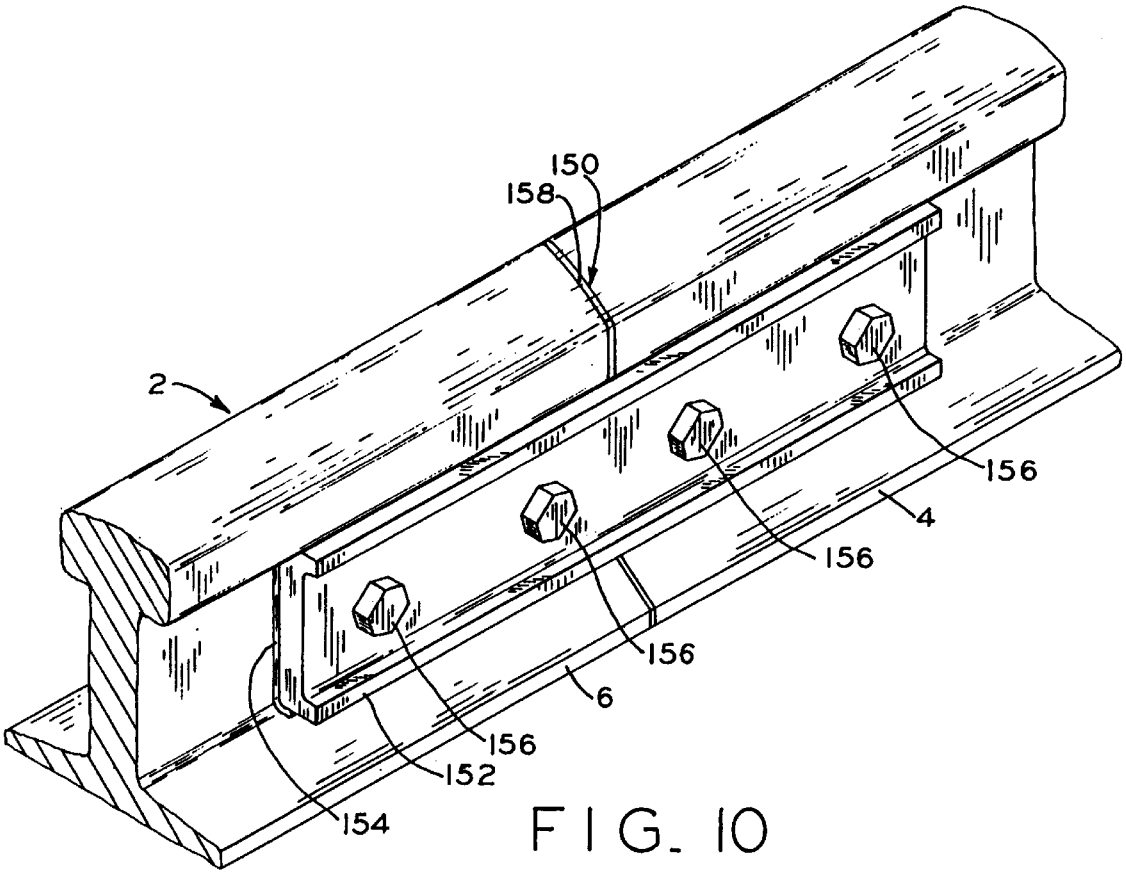
FIG. 10 is a perspective view of the railroad joint of the present invention.

Referring to FIGS. 8 and 9, the cut 150 resulting from the inventive power saw described above is at an angle in the range of about 5° to 30°, more particularly in the range of about 15° to 25°, or preferably about 20°, from a plane perpendicular to the axis of rail 2. The resulting joint 150 includes bar 152 connecting rail end 4 and rail end 6 of rail 2, dielectric material 154 on bar 152 and glued to rail 2, and bolts 156 with an insulating sleeve securing rail ends 4 and 6 together. This arrangement traps dielectric pad 158, which has a cross-sectional area matching the faces of rail ends 4 and 6, between their facing surfaces. The general construction of rail joints is well known in this field, and the rail joint of the present invention is advantageous in the angle of the cut relative to the axis of the rail realized between two adjoining rails. With the present invention, a train traversing over joint 150 would experience less of a "bump" from the interrupted hard steel rail surface because of the overlapping portions of the rail ends. Also, the angle of the cut minimizes the size of the extending end of the rail thereby creating a cut rail end which is capable of withstanding the large load of a train.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A joint for a railroad track, said joint comprising:

a pair of rails having matching ends, each of said rails defining an axial center, each of said ends having a facing surface disposed at an angle relative to a plane perpendicular to the axial center of the respective rail, said angle being in the range of about 20° to 30°;

a dielectric material disposed between said ends; and a bar attached to and connecting said rails.

2. The joint of claim 1 wherein said angle is about 20°.

3. The joint of claim 1 wherein said bar has an outer surface and said bar includes a dielectric material disposed over a portion of said outer surface located adjacent to said rails.

4. The joint of claim 3 further comprising glue disposed between said bar and said rails and adhering said dielectric material between said bar and said rails.

5. The joint of claim 1 further comprising a plurality of bolts extending through a plurality of holes in said bar and said rails.

6. The joint of claim 5 further comprising insulating sleeves disposed about said bolts.

7. The joint of claim 5 wherein said angle is about 20°.

* * * * *